US007562449B2

(12) United States Patent
Kuwayama et al.

(10) Patent No.: US 7,562,449 B2
(45) Date of Patent: Jul. 21, 2009

(54) METHOD OF CONNECTING TERMINAL TO WIRE

(75) Inventors: Yasumichi Kuwayama, Shizuoka (JP); Masanori Onuma, Shizuoka (JP); Nobuyuki Asakura, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 385 days.

(21) Appl. No.: 10/952,873

(22) Filed: Sep. 30, 2004

(65) Prior Publication Data

US 2005/0050725 A1 Mar. 10, 2005

Related U.S. Application Data

(62) Division of application No. 09/960,741, filed on Sep. 24, 2001, now abandoned.

(30) Foreign Application Priority Data

Sep. 22, 2000 (JP) ..... P.2000-288529

(51) Int. Cl.
*H01R 43/04* (2006.01)

(52) U.S. Cl. ..... 29/867; 29/865; 29/863; 29/861; 29/857; 29/745; 29/747; 29/748; 29/751; 29/753; 174/90; 439/442

(58) Field of Classification Search ..... 29/863, 29/857, 861, 862, 865, 866, 867, 745, 747, 29/748, 751, 753, 755; 174/90; 439/442
See application file for complete search history.

(56) References Cited

U.S. PATENT DOCUMENTS

| | | | | |
|---|---|---|---|---|
| 3,032,602 | A * | 5/1962 | Farnell | 174/90 |
| 3,404,368 | A | 10/1968 | Roberts et al. | |
| 3,744,114 | A | 7/1973 | Melsom | |
| 4,142,771 | A * | 3/1979 | Barnes et al. | 439/442 |
| 4,349,727 | A * | 9/1982 | Churchill | 219/544 |
| 5,191,710 | A | 3/1993 | Fujimaki et al. | |
| 5,445,535 | A | 8/1995 | Phillips, Jr. et al. | |
| 5,561,267 | A | 10/1996 | Fudoo et al. | |
| 6,098,443 | A | 8/2000 | Muller et al. | |
| 6,230,406 | B1 | 5/2001 | Blafour et al. | |

* cited by examiner

*Primary Examiner*—Rick K Chang
(74) *Attorney, Agent, or Firm*—Sughrue Mion, PLLC

(57) ABSTRACT

Inwardly-directed projecting portions (2, 3) are formed in a bent manner respectively at distal ends of a pair of clamping piece portions (4, 5) which are continuous with each other, and form a wire connection portion (7) of a terminal (1). A conductor portion (9) of a wire (8) is located on the inner sides of the pair of clamping piece portions (4, 5), and the pair of clamping piece portions are pressed over an entire periphery into a circular shape, and are extended in a peripheral direction, thereby causing projecting extension portions (2', 3'), including the projecting portions (2, 3), to bite into the conductor portion. Before the pressing operation, the pair of clamping piece portions (4, 5) may be provisionally pressed to be curved, thereby causing distal ends of the projecting portions (2, 3) to bite slightly into an outer peripheral surface of the conductor portion (9).

6 Claims, 8 Drawing Sheets

METHOD OF CONNECTING TERMINAL TO WIRE

This is a divisional of application Ser. No. 09/960 741, filed Sep. 24, 2001 now abandoned.

BACKGROUND OF THE INVENTION

1. Field of the Invention

The present invention relates to a method of connecting a terminal to a wire, in which a wire connection portion of the open barrel-type terminal is pressed over an entire periphery thereof, for example, by rotary swaging, and therefore is positively contacted with a conductor portion of the wire.

The present application is based on Japanese Patent Application No. 2000-288529, which is incorporated herein by reference.

2. Description of the Related Art

FIG. 8 shows a related structure of connecting a wire to a terminal, and a pair of clamping piece portions 56, extending upright respectively from opposite side edges of a bottom plate portion of the terminal 50, are pressed to be fastened to a conductor portion 45 at an end portion of the wire 44 (from which a sheath is removed), thereby contacting the clamping piece portions 56 with the conductor portion 45.

The terminal 50 is a press-clamping terminal of a so-called open barrel-type which includes a round plate-like electrical contact portion 46 formed at one end thereof, the pair of conductor-clamping piece portions 56 (serving as a wire connection portion), and a pair of sheath clamping piece portions 43 provided rearwardly of the clamping piece portions 56. The sheath clamping piece portions 43, provided at the rear end of the terminal, increase the strength of fixing of the terminal 50 to the wire 44, and prevent the conductor portion 45 from being withdrawn from the terminal 50 even when a large pulling force acts on the terminal 50 and the wire 44.

FIG. 9 shows a method of connecting the terminal 50 and the wire 44 together. The pair of clamping piece portions 56 are pressed into a generally spectacles-shape between an upper crimper 47 and a lower anvil 48 (which jointly provide a clamping jig), so that wire elements of the conductor portion 45 are compressed between the pair of clamping piece portions 56 and the bottom plate portion 49.

However, in this connecting method (connecting structure) using the press-clamping terminal 50, the pair of clamping piece portions 56 extend upwardly from the opposite side edges of the bottom plate portion 49 at an abrupt angle close to a right angle, and therefore a gap between the wire connection portion and the conductor portion 45 is liable to develop at the boundary between each clamping piece portion 56 and the bottom plate portion 49, and the area of contact of the wire connection portion with the conductor portion 45 is reduced, and the electrical resistance increases.

And besides, the pair of clamping piece portions 56 are curled inwardly from the opposite sides, and therefore the clamping width S of the terminal 50 is larger as compared with the clamping height H thereof, and in the case where a plurality of terminals 50 are received in a connector housing, made of a synthetic resin, in a juxtaposed manner, there has been encountered a problem that the width of each terminal receiving chamber and hence the overall width of the connector (including the connector housing and the terminals 50) increases. Furthermore, the sheath clamping piece portions 43 (FIG. 8) must be provided in order to increase the strength of fixing of the terminal 50 to the conductor 45, and this has invited a problem that the structure is complicated. There has been encountered a further problem that it is rather difficult to use this terminal for a wire of a large diameter since the area of contact of the clamping piece portions 56 with the conductor 45 is small.

On the other hand, as shown in FIG. 10, a so-called closed barrel-type terminal 51 for pressing a conduction portion at regions, spaced at equal intervals in the peripheral direction, has been used particularly for a wire 54 of a large diameter. This terminal 51 includes an electrical contact portion 52 of a tubular shape formed at one end thereof, and a wire connection portion 53 of a tubular shape at the other end thereof. A conductor portion at an end portion of the wire 54, from which a sheath is removed, is inserted into the wire connection portion 53, and in this condition the wire connection portion 53 is pressed or compressed at regions, spaced at equal intervals in the circumferential direction, to be formed into a hexagonal shape. A mating male terminal (not shown) is inserted or threaded into the electrical contact portion (front portion) 52 to be connected thereto.

FIG. 11 shows one method of connecting this kind of terminal 51 to the wire 54 (see Examined Japanese Utility Model Publication No. Sho. 50-43746).

In this connecting method, the conductor 61 of the wire 54 is inserted into a cylindrical wire connection portion 62 of the terminal, and in this condition the wire connection portion 62 is pressed into a hexagonal shape by a pair of upper and lower dies 63, thereby intimately contacting the conductor portion 61 with the inner surface of the wire connection portion 62. Each of the dies 63 includes three pressing surfaces 64, and elongate projections 65 each formed on the corresponding pressing surface 64 and disposed centrally of the width thereof. Each elongate projection 65 presses widthwise a central portion of the corresponding side of the outer peripheral surface of the hexagonal wire connection portion 62 in a radial direction, thereby enhancing the contact of the wire conductor portion 61 with the wire connection portion 62 of the terminal.

However, there has been encountered a problem that the cost of the crimp terminal 51 of the closed barrel-type is higher than that of the press-clamping terminal 50 of the open barrel-type. And besides, in the connecting method of FIG. 11, when the wire connection portion 62 of the terminal is pressed or compressed by the pair of upper and lower dies 63, large pressing forces (internal stresses), directed toward the center (axis) of the conductor portion 61, are exerted while pressing forces (internal stresses), acting on the opposite (right and left) side portions of the wire connection portion, are liable to be reduced. As a result, there have been possibilities that interstices or gaps are liable to develop in a bundle of wire elements of the conductor portion 61 at the opposite side portions of the wire connection portion 62 and that gaps are liable to develop between the conductor portion 61 and the wire connection portion 62. When such gaps develop, there is a possibility that the electrical resistance increases, so that the energizing efficiency is lowered, and also the connected portions are heated.

And besides, burrs 68 are liable to develop at the opposite (right and left) sides of the wire connection portion 62 at regions between the upper and lower dies 63, and this detracts from the appearance of the wire connection portion 62, and in addition the width of the wire connection portion 62 increases, and therefore much time and labor have been required for removing these burrs so as to avoid such disadvantages.

In the case where the elongate projections 65, formed on the dies 63 (FIG. 11), are relatively large in size, the cross-section of the wire conductor portion 61 is deformed into a generally polygonal shape since the elongate projections 65 press the conductor portion 61 in the radial direction at the six regions. As a result, a concentrated stress develops at each convex portion 67 of the wire connection portion 62 disposed between any two adjacent concave portions 66 thereof formed by the elongate projections 65, so that the pressing of the conductor portion 61 is not uniform over the entire periphery thereof. Therefore, there have been possibilities that interstices or gaps are liable to develop in the conductor portion 61 (that is, in the bundle of wire elements thereof) and that gaps are liable to develop between the conductor portion 61 and the wire connection portion 62 of the terminal.

SUMMARY OF THE INVENTION

With the above problems in view, it is an object of the present invention to provide a method of connecting a terminal to a wire, in which a conductor portion and a wire connection portion of the terminal can be positively contacted with each other with a large contact area without forming any gap between the conductor portion and the wire connection portion and also between wire elements of the conduction portion, and besides the width of the wire connection portion is prevented from increasing, so that the terminals can be arranged at a small pitch, and furthermore the withdrawal of the conductor portion is positively prevented upon application of a pulling force.

To achieve the above object, according to a first aspect of the present invention, there is provided a method of connecting a terminal to a wire. The method comprises the steps of:

forming inwardly-directed projecting portions in a bent manner respectively at distal ends of a pair of clamping piece portions which are continuous with each other and form a wire connection portion of a terminal;

locating a conductor portion of a wire on inner sides of the pair of clamping piece portions; and pressing the pair of clamping piece portions over an entire periphery thereof into a circular shape so as to extend in a peripheral direction, thereby causing projecting extension portions, including the projecting portions, to bite into the conductor portion of the wire.

According to a second aspect of the present invention, it is preferable that the pressing step is effected by a rotary swaging machine.

According to a third aspect of the present invention, it is preferable that the pressing step is effected, while the projecting portions of the pair of clamping piece portions are joined together.

According to a fourth aspect of the present invention, it is preferable that the method according to the first to third aspects further comprises forming the pair of projecting portions to have the same length and the same bending angle.

According to a fifth aspect of the present invention, it is preferable that the method according to the first to fourth aspects further comprises:

before the pressing step, provisionally pressing the pair of clamping piece portions to be curved; and causing distal ends of the projecting portions to bite slightly into an outer peripheral surface of the conductor portion.

According to a sixth aspect of the present invention, it is preferable that the method according to the first aspect, further comprises:

forming a first one of the projecting portions of the pair of clamping piece portions to be shorter than a second one of the projecting portions;

bending the first one of the projecting portions inwardly at a deep angle; and bending the second one of the projecting portions inwardly at a shallow angle, wherein when the pressing step is effected, one of the projecting extension portions, including the first one of the projecting portions, is caused to bite into the conductor portion of the wire while the other one of the projecting extension portions, including the second one of the projecting portions, is held in intimate contact with an outer peripheral surface of the conductor portion.

According to a seventh aspect of the present invention, it is preferable that, in the method of the sixth aspect, a distal end of the other one of the projecting extension portions is joined to a bent proximal end of the one of the projecting extension portions while the one of the projecting extension portions is caused to bite into the conductor portion of the wire.

According to an eighth aspect of the present invention, it is preferable that, in the method according to the sixth and seventh aspects, a biting direction of the one of the projecting extension portions is deviated outwardly from an axis of the conductor portion of the wire.

According to a ninth aspect of the present invention, it is preferable that the method according to the sixth to eighth aspects further comprises:

before the pressing step, provisionally pressing the pair of clamping piece portions to be bent;

causing a distal end of the first one of the projecting portions to bite slightly into the outer peripheral surface of the conductor portion; and superposing the second one of the projecting portions on an outer side of a bent proximal end of the first one of the projecting portions.

BRIEF DESCRIPTION OF THE DRAWINGS

The above and other objects and advantages of the present invention will become more apparent by describing in detail preferred embodiments thereof with reference to the accompanying drawings, wherein.

DETAILED DESCRIPTION OF THE PREFERRED EMBODIMENTS

Preferred embodiments of the present invention now will be described in detailed with reference to the drawings. FIGS. 1 and FIGS. 2A to 2C show a first embodiment of a terminal-wire connecting method (structure) of the present invention.

Figure 1:
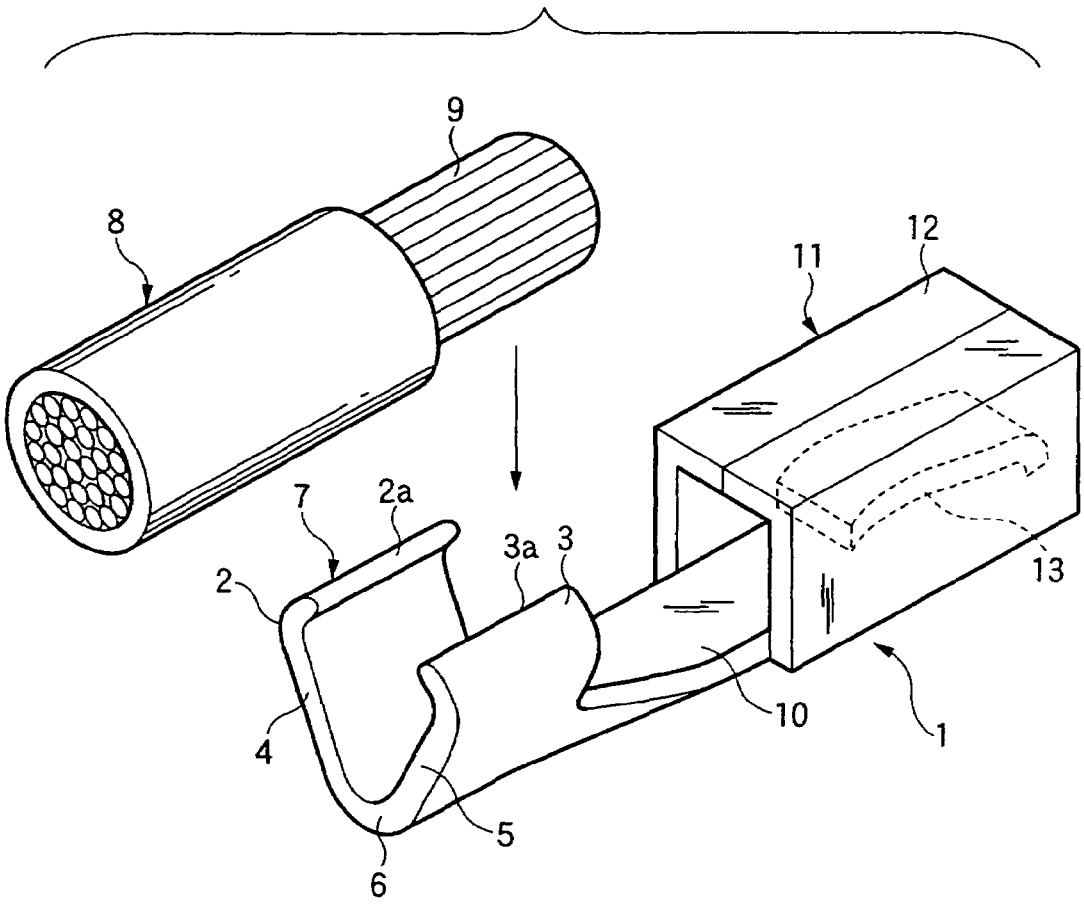
FIG. 1 is an exploded, perspective view showing a terminal and a wire in their respective initial shapes, which are used in a first embodiment of a terminal-wire connecting method of the present invention.
Figure 2A:
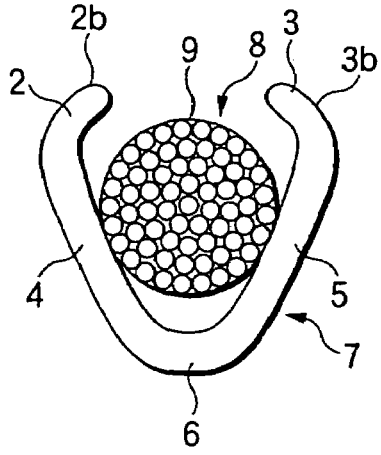
FIGS. 2A to 2C are cross-sectional views showing sequentially the working steps of the terminal-wire connecting method.
Figure 2B:
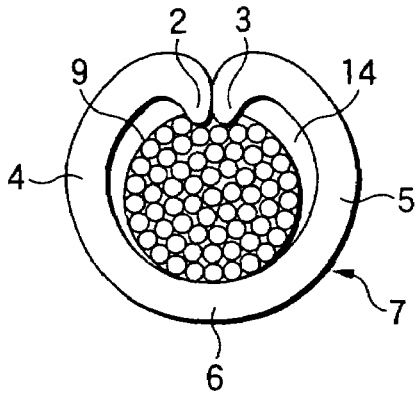
Figure 2C:
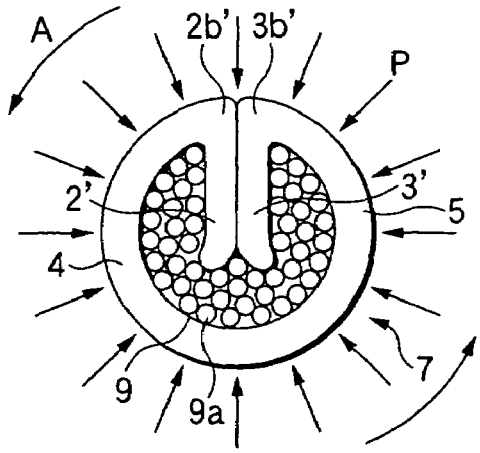

In this connecting method, a conductor portion 9 at the portion of a wire 8, from which a sheath is removed, is set in a generally V-shaped wire connection portion 7 of a terminal 1 (FIG. 1) having projecting portions 2 and 3 formed respectively at opposite ends thereof (FIG. 2A), that in this condition, the wire connection portion 7 is provisionally pressed into a generally round shape (FIG. 2B), and that the wire connection portion 7 is pressed radially inwardly (toward the center) over an entire periphery thereof, thereby causing a pair of projecting extension portions 2' and 3' of the wire connection portion 7 to bite into the conductor portion 9 toward the center of the wire (FIG. 2C).

As shown in FIG. 1, the terminal 1 includes an electrical contact portion 11 of a square tubular shape, formed at one end of a rectangular base plate portion 10, and the wire connection portion 7 formed at the other end of the base plate portion 10. The electrical contact portion 11 includes a peripheral wall 12, extending from the base plate portion 10, and a resilient contact piece portion 13 provided within the peripheral wall 12. The peripheral wall 12 is formed by bending metal sheet portions, extending horizontally respectively from opposite side edges of the base plate portion 10, into a generally U-shape. The form of the electrical contact portion 11 is not limited to that shown in FIG. 1, but it may have, for example, a cylindrical shape or a tab-like (male-type) shape.

The wire connection portion 7 is formed by bending the end portion of the base plate portion 10, having metal sheet portions extending horizontally respectively from the opposite side edges thereof, is bent at a central portion thereof into a generally V-shape, and further distal end portions of a pair of clamping piece portions (opposite side portions) 4 and 5, are bent inwardly at an angle of about 90 degrees to form the projecting portions 2 and 3, respectively.

Preferably, a bottom portion 6 of the wire connection portion 7, extending from the base plate portion 10, is curved into a generally arcuate shape. That portion of the terminal, interconnecting the base plate portion 10 and the wire connection portion 7, may be curved into a shape similar to that of the bottom portion 6, or may be smaller in width than the base plate portion 10.

Preferably, a distal end 2*a*, 3*a* of each of the projecting portions 2 and 3 is defined by a smoothly-curved surface. The pair of clamping piece portions 4 and 5 have the same length and the same inclination angle (opening angle) in the direction of the height. The wire connection portion 7 is symmetrical with respect to a median plane of the terminal. The distance between the distal ends 2*a* and 3*a* of the pair of projecting portions 2 and 3 is larger than the outer diameter of the conductor portion 9 of the wire 8, and the conductor portion 7 can be inserted into the wire connection portion 8 through the gap between the distal ends of the projecting portions 2 and 3. The length of the wire connection portion 7 between its front and rear ends (that is, in the longitudinal direction of the terminal) is equal to or slightly shorter than the length of the (sheath-removed) conductor portion 9. The wall thickness of the wire connection portion 7 is uniform over the entire area thereof. Alternatively, the projecting portions 2 and 3 may be made smaller in thickness than the clamping piece portions 4 and 5.

The process of connecting the terminal to the wire is shown in FIGS. 2A to 2C. First, the conductor portion 9 of the wire 8 is inserted between the pair of clamping piece portions 4 and 5 of the wire connection portion 7 as shown in FIG. 2A. It may be inserted from the upper side or from the rear side (that is, the V-shaped opening). The wire 8 can be easily set by inserting the conductor portion through the upper gap. The outer peripheral surface of the conductor portion 9 is held in contact with intermediate portions of the pair of clamping piece portions 4 and 5, and the conductor portion 9 is disposed at a generally central portion of the wire connection portion 7.

In this condition, the wire connection portion 4, 5 is provisionally pressed into a curved shape as shown in FIG. 2B. This provisional pressing operation is effected, for example, by pressing the pair of clamping piece portions 4 and 5 by a pair of right and left arcuate pressing tools (not shown) from the opposite sides. The pair of clamping piece portions 4 and 5 may be manually pressed inwardly by pincers.

As a result of this provisional pressing operation, the bottom portion 6 of the wire connection portion 7 and the pair of clamping piece portions 4 and 5 are deformed into a generally cylindrical shape, and the pair of projecting portions 2 and 3, formed respectively at the distal ends of these clamping piece portions, slightly bite into the outer peripheral surface of the conductor portion 9, with their outer surfaces 2*b* and 3*b* (FIG. 2A) joined together, so that the conductor portion 9 is fixedly held between the bottom portion 6 and the distal ends of the projecting portions 2 and 3. A small gap 14 is formed between the inner surface of each of the clamping piece portions 4 and 5 and the outer peripheral surface of the conductor portion 9. When the conductor portion 9 is thus provisionally fixed, the conductor portion 9 is prevented from withdrawal from the wire connection portion 7, and the subsequent complete pressing operation can be effected easily.

The complete pressing operation is effected by pressing the wire connection portion 7 uniformly over the entire periphery thereof as shown in FIG. 2C. The term "over the entire periphery" means "throughout the entire peripheral surface". When the wire connection portion 7 is thus pressed over the entire periphery thereof, the inner peripheral surface of the wire connection portion 7 is brought into intimate contact with the outer peripheral surface of the conductor portion 9, with no gap formed therebetween, and wire elements 9 of the conductor portion 9 are firmly closely contacted with one another, and the clamping piece portions 4 and 5 are extended or elongated (in a plastically-deformed manner) in the peripheral direction. These extended portions are prevented by a press-clamping tool from escaping to the exterior, and therefore these extended portions, together with the projecting portions 2 and 3 (FIG. 2B), are extended inwardly, that is, toward the center (axis) of the conductor portion 9, to bite, as the projecting extension portions 2' and 3', deep into the conductor portion 9. Bent proximal ends 2*b'* and 3*b'* of the projecting extension portions 2' and 3' are continuous respectively with the clamping piece portions 4 and 5 of a round shape. The clamping piece portions 4 and 5 are extended or elongated in the peripheral direction, and therefore their wall thickness in the final form is smaller than that shown in FIG. 2B.

In the provisional pressing operation of FIG. 2B, the pair of projecting portions 2 and 3 are joined together, and therefore in the complete pressing operation of FIG. 2C, the extended portions of the clamping piece portions, bite, as the projecting extension portions 2' and 3', firmly into the conductor portion 9 toward the center thereof, with the projecting extension portions 2' and 3' kept joined together in a plane, in which the centerline (axis) of the conductor portion 9 lies, since these extended portions can move only toward the center of the conductor portion 9.

As a result, the area of contact between the conductor portion 9 and the wire connection portion 7 increases, and the positive electrical connection therebetween is achieved with a low electrical resistance. Since the projecting extension portions 2' and 3' bite deep into the conductor portion 9, the strength of fixing of the conductor portion 9 to the wire connection portion 7 increases, thereby positively preventing the withdrawal of the conductor portion 9. The pair of left and right projecting extension portions 2' and 3' are joined together, with substantially no gap formed therebetween, and therefore the wire connection portion 7 is formed into a cylindrical shape, and an electrical resistance between the projecting extension portions 2' and 3' is reduced, and besides the intrusion of water and so on into the conductor portion 9 from the exterior is prevented.

There may be used a method in which the pair of clamping piece portions 4 and 5 of the terminal 1 (FIG. 1) in its initial shape are curved into an arcuate shape as obtained immediately before the provisional pressing operation of FIG. 2B, and at the time of setting the wire, the conductor portion 9 is inserted into the wire connection portion 7 not from above but from the rear opening.

The complete pressing operation can be easily effected, for example, by a working portion 16 of a rotary swaging machine (shown in FIG. 3) which is one form of entire-periphery pressing machine.

Figure 3:
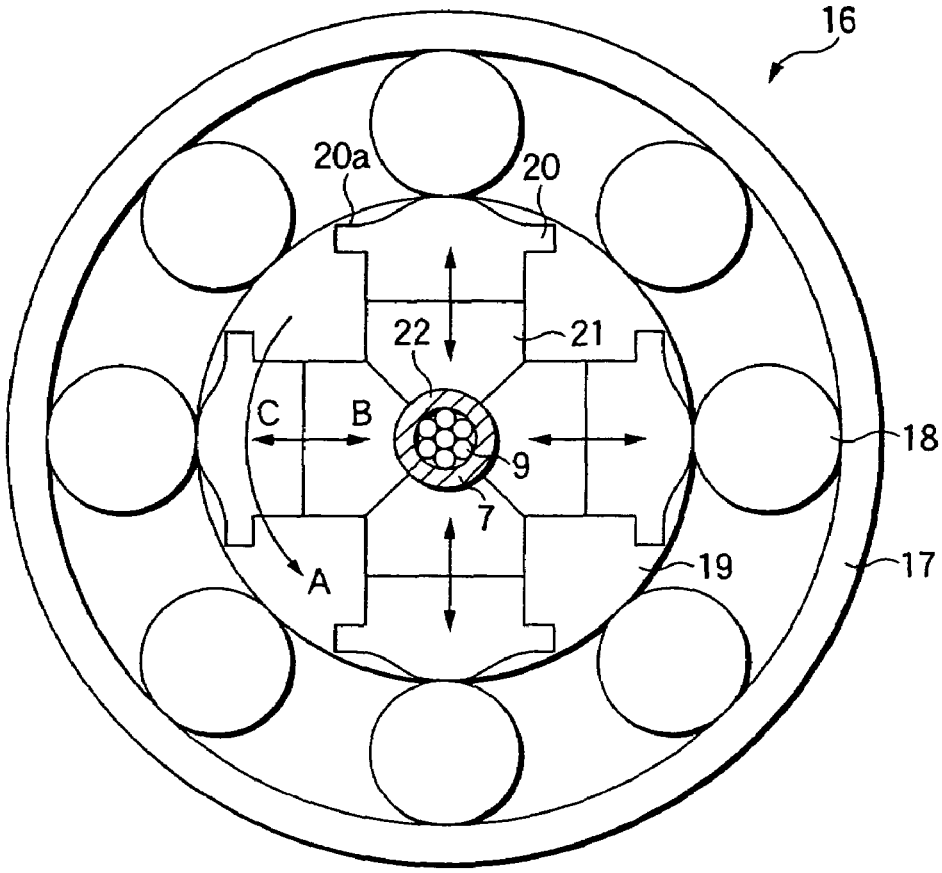
FIG. 3 is a front-elevational view showing a working portion of a rotary swaging machine serving as an entire-periphery pressing machine.

In FIG. 3, reference numeral 7 denotes the wire connection portion of the terminal 1 (FIG. 1), reference numeral 9 the conductor portion of the wire 8, reference numeral 17 an outer ring, reference numeral 18 a rotatable roller, reference numeral 19 a spindle for being driven for rotation, reference numeral 20 a bucker (hammer) movable in a radial direction, and reference numeral 21 a die movable in the radial direction.

The spindle 19 is rotated by a motor (not shown). The four dies 21 are circumferentially arranged in contiguous relation to one another, and are movable in the radial direction of the wire 8. A circular hole 22 for receiving the wire connection portion 7 of the terminal is formed in a central portion of a die assembly comprising the dies 21. Each die 21 is movable, together with the associated bucker 20 provided at the outer side thereof, in the radial direction of the wire. An outer surface of the bucker 20 defines a cam surface 20*a* of a mountain-like shape. The dies 21 and the buckers 20 rotate together with the spindle 19. The cam surface 20*a* of each bucker 20 can contact the outer peripheral surfaces of the outside rollers 18, and the plurality of rollers 18 are arranged at equal intervals between the inside spindle 19 and the outside ring 17, and each of the rollers 18 can rotatably contact the cam surfaces 20*a* and the outer peripheral surface of the spindle 19, and rotatably contacts the inner peripheral surface of the ring 17.

When the spindle 19 is rotated by the motor (not shown), the dies 6 and the buckers 20 are rotated (or angularly moved) in unison in a direction of arrow A, and the cam surface 20*a* of each bucker 20 is brought into sliding contact with the outer peripheral surface of the roller 18, and when the apex of each cam surface 20*a* is brought into contact with the roller 18, the four dies 21 are closed as indicated by arrows B. Then, the buckers 20 and the dies 21 are moved outwardly as indicated by arrows C under the influence of a centrifugal force, and a foot portion of each cam surface 20*a* is brought into contact with the roller 18, so that the four dies 21 are opened. Thus, the four dies 21, while rotating, are opened and closed.

When the dies 21 are closed, the wire connection portion 7 of the terminal is pounded by arcuate inner surfaces (designated at 22) of the dies 21, and is compressed radially. When the dies 21 are opened, a gap is formed between the inner surface 22 of each die 21 and the outer peripheral surface of the wire connection portion 7 of the terminal. The dies 21, while rotating, are thus repeatedly opened and closed, and by doing so, the conductor portion 9 of the wire is pressed into a generally circular shape by the wire connection portion.

In FIG. 2C, arrows P in the radial direction indicate the uniform pressing forces, and arrows A in the peripheral (circumferential) direction indicate the direction of rotation of the dies 21 (FIG. 3).

The dies 21, while rotating, compress the wire connection portion 7 of the terminal 1 (FIG. 1) radially, and therefore any burr does not develop at the wire connection portion 7, and the outer surface of the wire connection portion 7 is finished beautifully. At the same time, the wire connection portion 7 is pressed by the force, applied uniformly over the entire periphery thereof, and the internal stresses of the conductor portion 9 and the wire connection portion 7 are made uniform, and the formation of interstices in the wire elements 9*a* of the conductor portion 9, as well as the formation of gaps between the conductor portion 9 and the wire connection portion 7, is eliminated.

The number of the dies 21, as well as the number of the buckers 20, is not limited to four, but may be two. In this case, two dies 21, each having a semi-circular pressing surface, are arranged symmetrically in the direction of 180 degrees. The means for pressing the wire connection portion 7 of the terminal uniformly over the entire periphery thereof is not limited to the rotary swaging machine, but may be other working machine (not shown).

By changing the dies 21 and so on, the rotary swaging machine can work various wires and terminals, for example, from a thick wire 21 with a cross-sectional area of about 20 $mm^2$ and a thick terminal with a thickness of about 2.2 mm to a thin wire with a cross-sectional area of about 0.3 $mm^2$ and a thin terminal with a thickness of about 0.25 mm.

Figure 4:
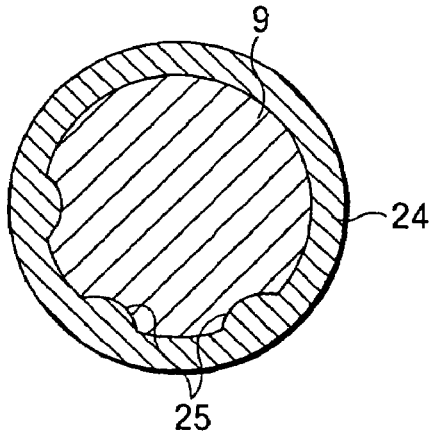
FIG. 4 is a cross-sectional view (explanatory view) showing a drawback encountered when a cylindrical wire connection portion of a terminal is pressed over an entire periphery thereof.

When a wire connection portion 24 of a terminal, having an initial cylindrical shape, is pressed over an entire periphery thereof by the above rotary swaging machine as shown in FIG. 4, the wire connection portion 24 is extended or elongated in its longitudinal direction (axial direction), and if this extension is not sufficient, there is a possibility that wrinkles 25 are formed on the inner side of the wire connection portion 24 since the extended wire connection portion 24 can not escape to the exterior (that is, is enclosed by the dies 21), as shown in FIG. 4. Reference numeral 9 denotes a conductor portion.

Figure 5:
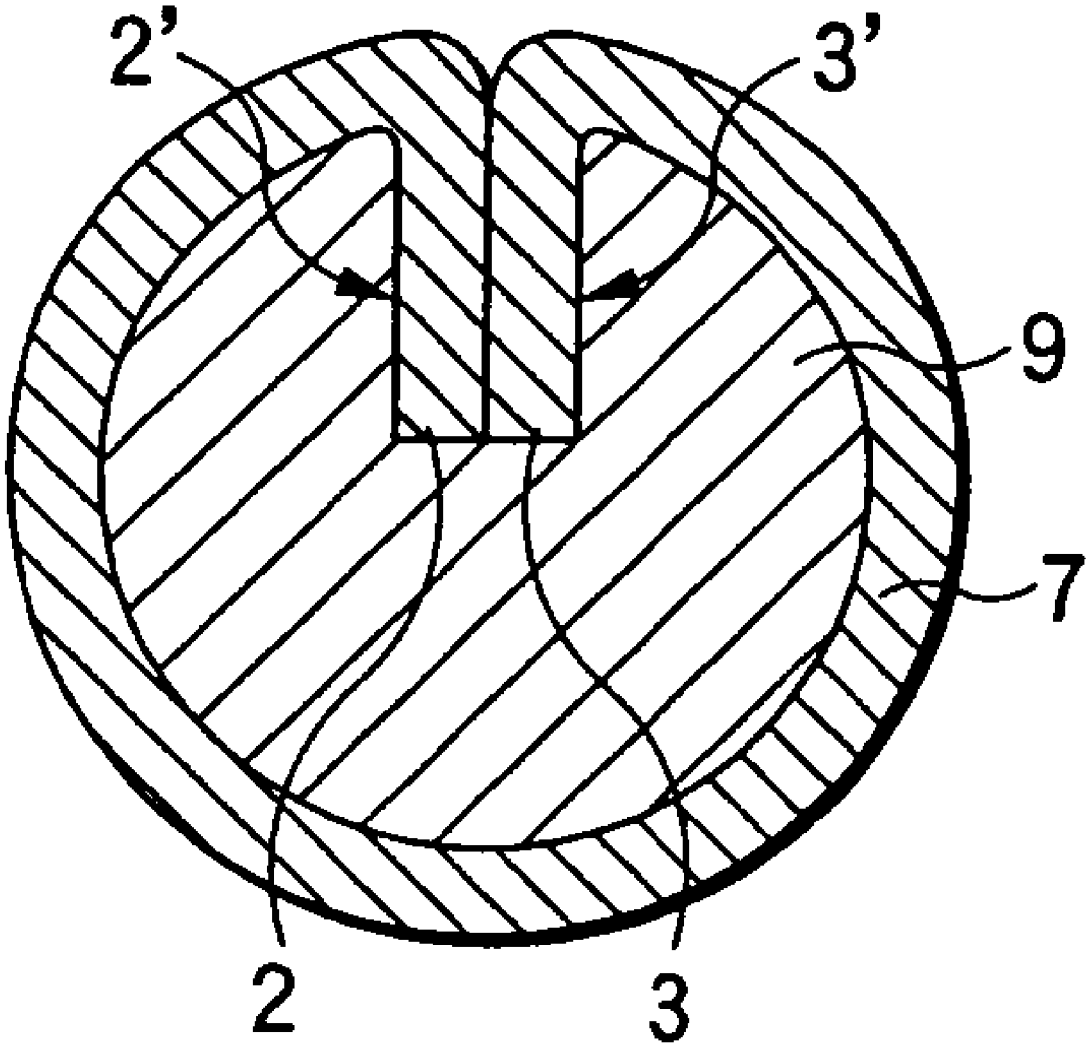
FIG. 5 is a cross-sectional view (explanatory view) showing a wire connection portion of a first embodiment pressed over an entire periphery thereof.

However, in the case of the terminal 1 of the present invention shown in FIG. 5, when the wire connection portion 7 is pressed over the entire periphery thereof as described above, this wire connection portion 7 is extended (plastically deformed) in the peripheral direction, and the extended portions can not escape to the exterior, and therefore these extended portions, together with the projecting portions 2 and 3, are extended inwardly, that is, toward the center (axis) of the conductor portion 9, to bite, as the projecting extension portions 2' and 3', deep into the conductor portion 9. Therefore, any wrinkle is not formed on the inner side of the wire connection portion 7. Namely, using the rotary swaging and the wire connection portion 7, having the inwardly-directed projecting portions 2 and 3, in combination, there is achieved the connecting structure in which the area of contact with the conductor portion 9 is large, and the electrical resistance is low.

And besides, the wire connection portion 7 is formed into a circular shape, and therefore the electrical connection portion 7 is made compact, and in the case where a plurality of terminals 1 are arranged in a juxtaposed manner, the pitch of these terminals can be made small, so that the connecting structure, such as a connector, receiving the terminals 1, can be made compact.

Figure 6:
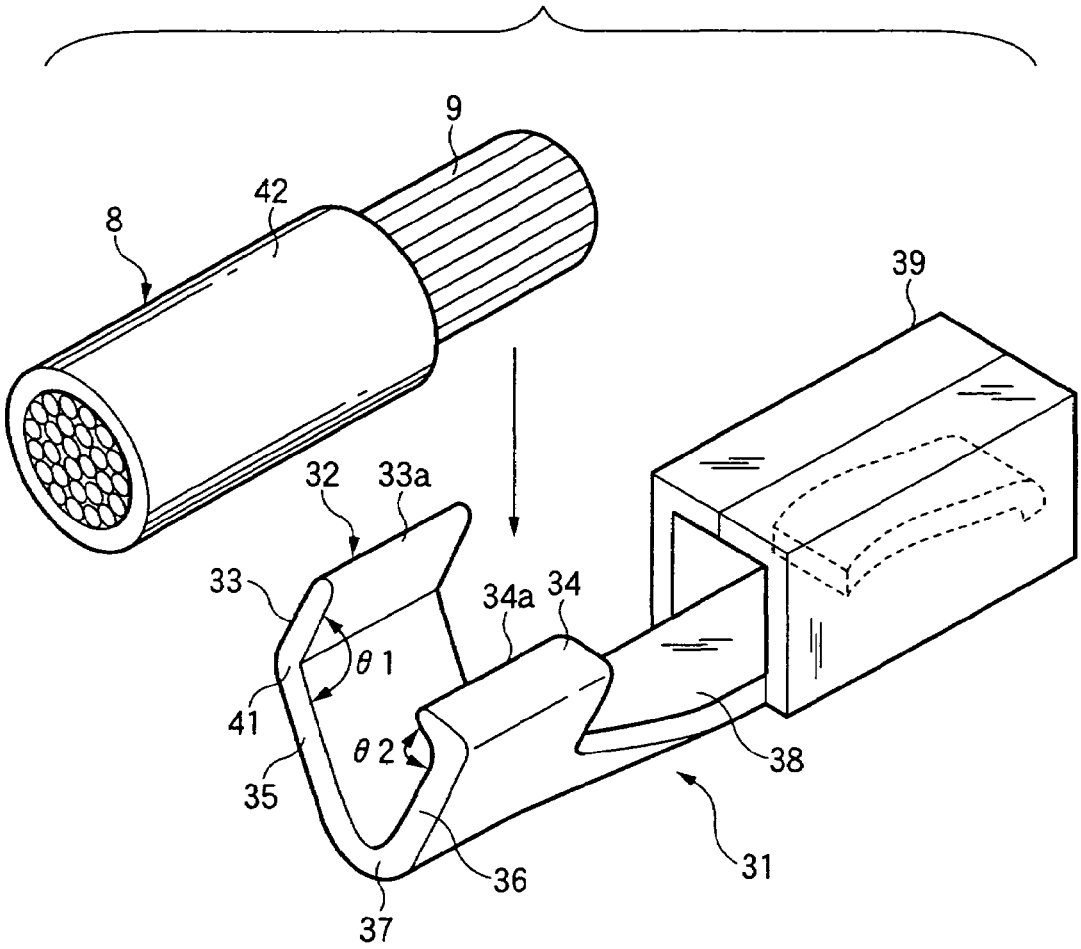
FIG. 6 is an exploded, perspective view showing a terminal and a wire in their respective initial shapes, which are used in a second embodiment of a terminal-wire connecting method of the present invention.

FIGS. 6 and 7 show a second embodiment of a terminal-wire connecting method (connecting structure) of the present invention.

In this connecting method, a projecting portion 33 of one clamping piece portion 35 of a generally V-shaped wire connection portion 32 of a terminal 31 (FIG. 6) is longer while a projecting portion 34 of the other clamping piece portion 34 is shorter, and a bending angle $\theta_1$ of the longer projecting portion 33 is shallow while a bending angle $\theta_2$ of the shorter projecting portion 34 is deep. When the wire connection portion 32 is pressed over the entire periphery thereof (FIG. 7C), a projecting extension portion 34', including the shorter projecting portion 34, bites into a conductor portion 9 of a wire 8 at a relatively gentle angle $\theta_3$ while a projecting extension portion 33', including the longer projecting portion 33, is extended arcuately around an outer peripheral surface of the conductor portion 9, and is disposed outwardly of the projecting extension portion 34'.

As shown in FIG. 6, the terminal 31 includes an electrical contact portion 39, formed at one end of a base plate portion 38, and the wire connection portion 32 formed at the other end of the base plate portion. The electrical contact portion 39, the base plate portion 38, and an interconnecting portion, interconnecting the base plate portion 38 and the wire connection portion 32, are similar in construction to those of the first embodiment, respectively, and therefore description thereof will be omitted here.

The pair of left and right clamping piece portions 35 and 36 are equal or generally equal in length to each other. The projecting portion 33 of the one clamping piece portion 35 is longer while the projecting portion 34 of the other clamping piece portion 36 is shorter. The longer projecting portion 33 projects obliquely upwardly at the gentle bending angle $\theta_1$ while the shorter projecting portion 34 projects toward an intermediate portion of the longer projecting portion 33, disposed in a direction of the height thereof, at the relatively-abrupt bending angle $\theta_2$ of about 90 degrees.

A gap, larger than the outer diameter of the conductor portion 9, is formed between distal ends 33*a* and 34*a* of the projecting portions 33 and 34, and the conductor portion 9 can be set in the wire connection portion 32 from the upper side. The length of the wire connection portion 32 between its front and rear ends is equal to or slightly shorter than the length of the conductor portion 9. These are the same as in the first embodiment. Each of the projecting portions 33 and 34 may be tapering, that is, decreasing in thickness gradually toward the distal end thereof. Preferably, the distal end 33*a*, 34*a* of each of the projecting portions 33 and 34 is defined by a curved surface.

The method of connecting the terminal to the wire will be described with reference to FIGS. 7A to 7C.

Figure 7A:
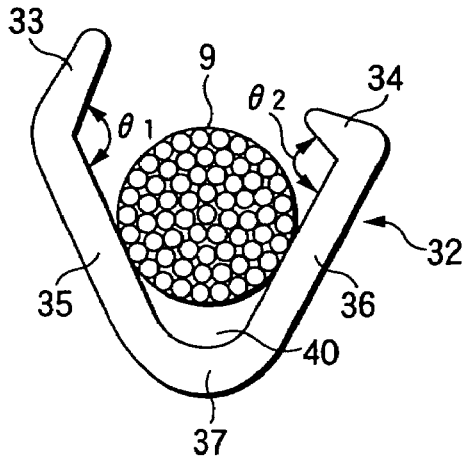
FIGS. 7A to 7C are cross-sectional views showing sequentially the working steps of the terminal-wire connecting method.
Figure 7B:
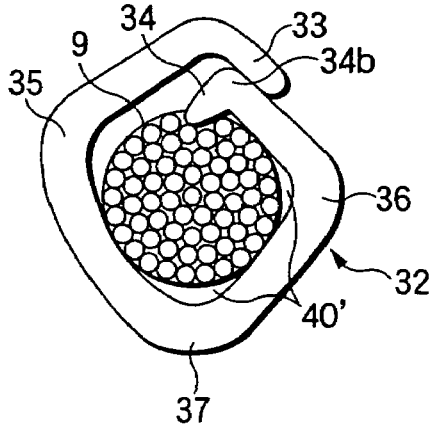

First, the conductor portion 9 of the wire 8 is inserted and set in the wire connection portion 32 of the terminal 31 as shown in FIG. 7A. The conductor portion 9 is held in contact with intermediate portions of the pair of clamping piece portions 35 and 36, and is disposed at a generally central portion of the wire connection portion 32. A gap 40 is formed between the conductor portion 9 and a bottom portion 37 of the wire connection portion 32 which is curved with a small radius of curvature.

After the wire 8 is set, a provisional pressing operation is effected, and in this operation, each of the left and right clamping piece portions 35 and 36 is bent at a generally central portion thereof in the direction of the height, and as a result the shorter projecting portion 34 is contacted with the outer peripheral surface of the conductor portion 9 in underlying relation to the longer projecting portion 33 while the longer projecting portion 33 is contacted with the outer surface of the clamping piece portion 36 (having the shorter projecting portion 34) in overlying relation to the shorter projecting portion 34.

Namely, when the left and right clamping piece portions 35 and 36 are simultaneously provisionally pressed respectively, for example, by a pair of left and right arcuate pressing tools (not shown) or pincers, the shorter projecting portion 34 is first brought into contact with the outer peripheral surface of the conductor portion 9, and the distal end of this projecting portion 34 slightly bites into the conductor portion 9, and subsequently the longer projecting portion 33 is superposed on a bent proximal end 34*b* of the shorter projecting portion 34. This operation is effected with the above construction in which the shorter projecting portion 34 is inwardly bent at the abrupt angle while the longer projecting portion 33 is bent at the gentle angle to be directed outwardly. This is effective particularly for an automatic machine. A manual operation can be used, in which case the clamping piece portion 36, having the shorter projecting portion 34, is first intentionally provisionally bent, and then the clamping piece portion 35, having the longer projecting portion 33, is provisionally pressed.

The shorter projecting portion 34 is directed to a point slightly deviated from the center (axis) of the conductor portion 9. In the first embodiment, the pair of projecting portions 2 and 3 are directed toward the center of the conductor portion 9 (FIG. 2B). In this embodiment, however, the shorter projecting portion 34, when provisionally pressed (FIG. 7B), is directed to the point slightly deviated from the center of the conductor portion 9 so that the bending angle $\theta_3$ of the projecting extension portion 34', obtained in the complete pressing operation (FIG. 7C), can be made gentler (larger) as compared with the first embodiment.

In the provisional pressing operation, the distal end of the shorter projecting portion 34 bites shallow into the conductor portion 9, so that the conductor portion 9 is fixed within the wire connection portion 32. In the provisional pressing operation, a small gap 40' is formed between the outer peripheral surface of the conductor portion 9 and each of the clamping piece portions 35 and 36, and also a small gap 40' is formed between the outer peripheral surface of the conductor portion 9 and the bottom portion 37. The conductor portion 9 is stably supported at three points, that is, by the distal end of the shorter projecting portion 34 and the left and right clamping piece portions 35 and 36.

Figure 7C:
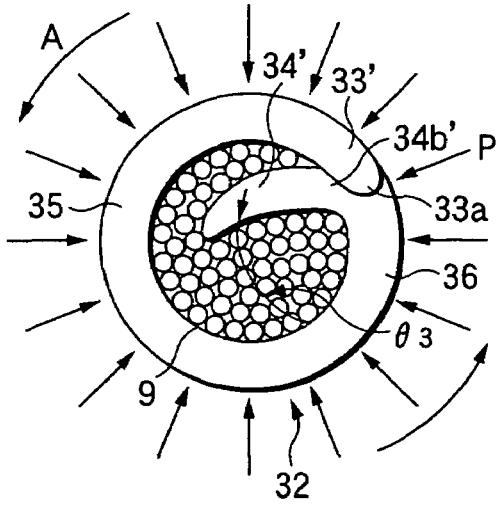

After the provisional pressing operation, the wire connection portion 32 is completely pressed over the entire periphery thereof as shown in FIG. 7C. The complete pressing operation is effected, for example, by the above-mentioned rotary swaging machine (FIG. 3) which is an entire-periphery pressing machine. In FIG. 7C, arrows P indicate pressing forces in the radial direction, and the pressing forces P act on the wire connection portion uniformly over the entire periphery thereof.

Arrows A in the peripheral (circumferential) direction indicate the direction of rotation of the dies 21 (FIG. 3). Preferably, the dies 21 are rotated in such a direction (left direction (FIG. 7C) as indicated by arrows A) as to cause the projecting extension portion 34' to bite into the conductor portion 9. Namely, when the direction of extending of the clamping piece portion 36 coincides with the direction of rotation of the dies 21, the projecting extension portion 34' is smoothly formed, and bites into the conductor portion.

With this entire-periphery pressing operation, the wire connection portion 32 is extended in the peripheral direction, and the outer side of the wire connection portion 32 is prevented by the dies 21 (FIG. 3) from escaping, and the shorter projecting portion 34 is prevented by the longer projecting portion 33 from escaping in the peripheral direction, and therefore the extended (elongated in a plastically-deformed manner) portion of the wire connection portion 32, extended in the peripheral direction thereof, moves in the direction of projecting of the shorter projecting portion 34 (FIG. 7B), and bites, as the projecting extension portion 34', deep into the conductor portion 9. At this time, the projecting extension portion 33', formed at the outside projecting portion 33, urges or presses the bent proximal end 34*b*' of the projecting extension portion 34' radially inwardly of the conductor portion, thereby assisting the projecting extension portion 34' in biting into the conductor portion. The projecting extension portion 33', disposed radially outwardly of the projecting extension portion 34', is held in firm, intimate contact with the outer peripheral surface of the conductor portion 9, and the distal end 33*a* of the outside projecting extension portion 33' contacts the bent proximal end 34*b*' of the inside projecting extension portion 34', with no gap formed therebetween, thereby preventing water and so on from intruding into the conductor portion 9.

The inside projecting extension portion 34' extends into the conductor portion 9 at the relatively gentle (large) bending angle $\theta_3$ as compared with the angle of the projecting extension portions 2' and 3' of the first embodiment (FIG. 2C). Therefore, a concentrated stress less develops at the bending proximal end 34*b*', thus eliminating the possibility of cracks and so on. There are provided the two projecting extension portions 2' and 3' in the first embodiment whereas there is the single projecting extension portion 34' in this embodiment. Therefore, the overall amount of extending of the wire connection portion 32 in the peripheral direction is smaller, and the time, required for the working, is reduced, and besides the wire connection portion 32 has a relatively large wall thickness, and the pressing stresses are large, and the force of fastening the conductor portion 9 is large.

Figure 8:
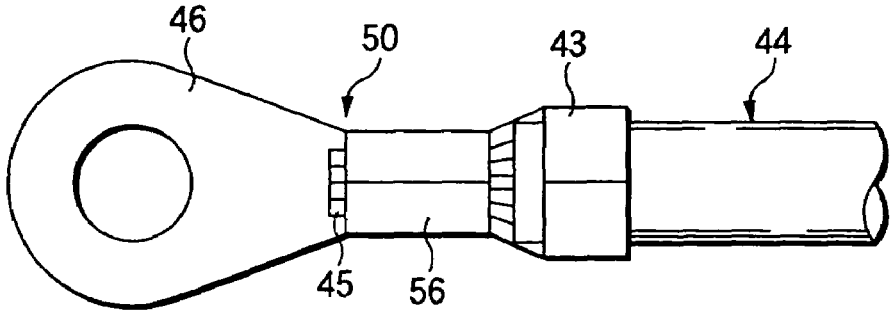
FIG. 8 is a plan view showing a connecting structure employing a related open barrel-type press-clamping terminal.
Figure 9:
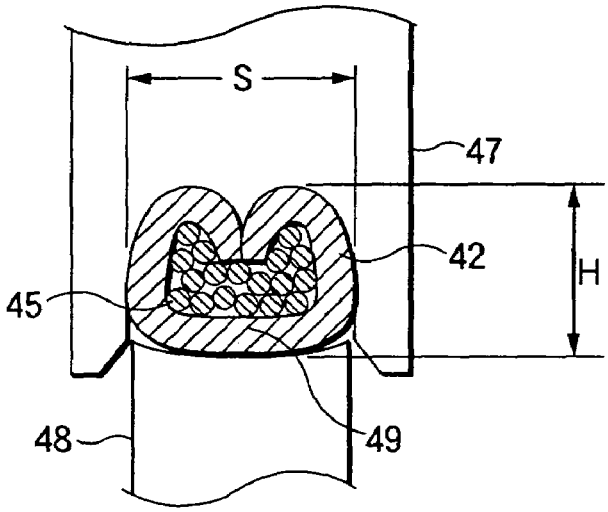
FIG. 9 is a cross-sectional view (explanatory view) showing a connecting method.
Figure 10:
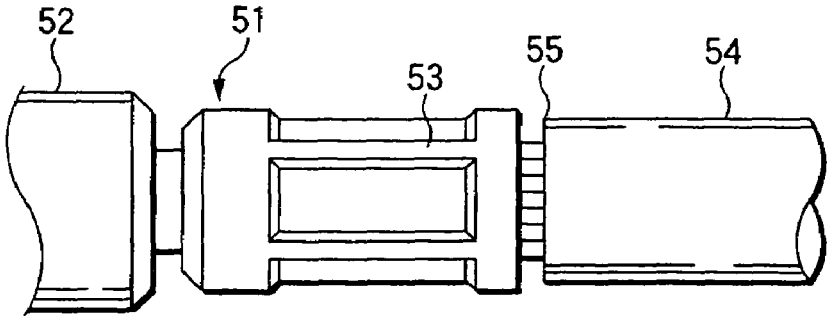
FIG. 10 is a plan view showing a connecting structure employing a related closed-type crimp terminal.
Figure 11:
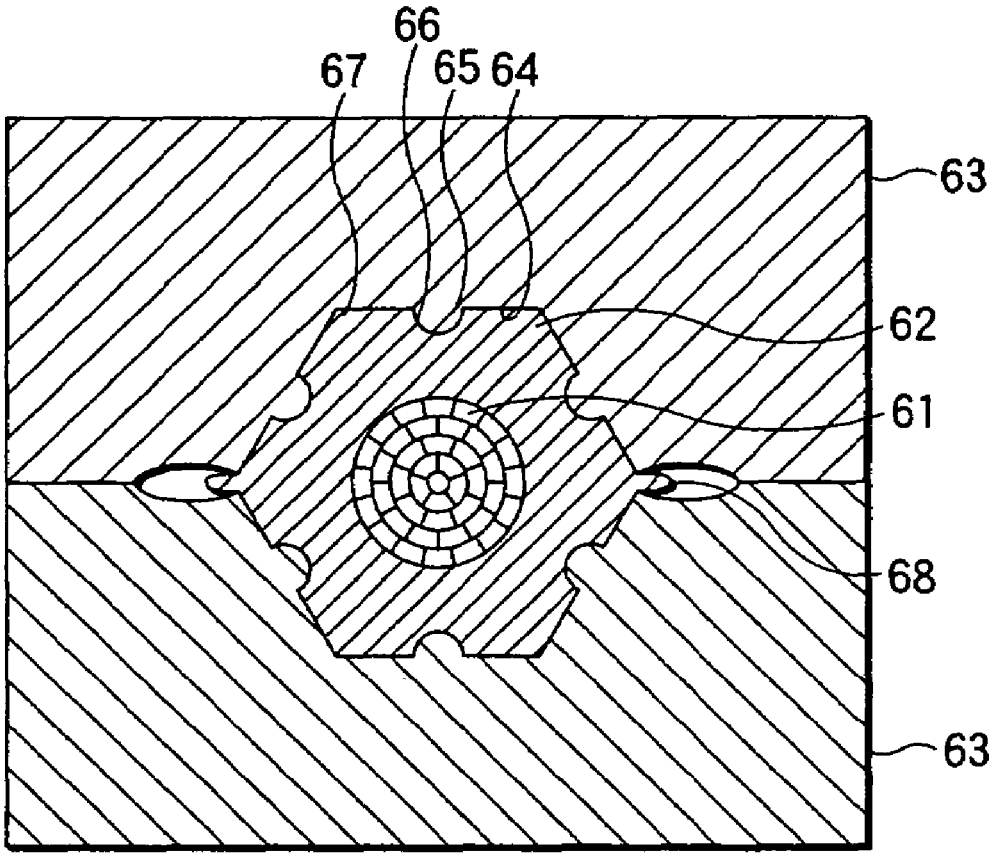
FIG. 11 is a cross-sectional view showing one connecting method employing the crimp terminal.

As in the first embodiment, the entire-periphery pressing operation, effected by rotating the dies 21 (FIG. 3), prevents any burr from developing on the outer periphery of the wire connection portion 32, and the outer peripheral surface is finished beautifully, and besides the wire connection portion 32 is formed into a circular or generally circular shape. Therefore, as compared with the open barrel-type press-clamping terminal (see FIG. 8) and the closed-type crimp terminal (see FIG. 10), the horizontal width and vertical width of the wire connection portion 32 can be made smaller, and for example, a plurality of terminals 31 can be arranged in a juxtaposed manner at a small pitch, and a structure for receiving the terminals 31, such for example as a connector (not shown), can be made compact.

The projecting extension portion 34' bites deep into the conductor portion 9, and therefore the area of contact between the conductor portion 9 and the wire connection portion 32 increases, and the electrical contact is enhanced, and besides the strength of fixing of the conductor portion 9 to the wire connection portion 32 increases, and the conductor portion 9 is prevented from withdrawal upon application of a pulling force or the like, and it is not necessary to provide sheath-clamping piece portions as provided at the press-clamping terminal (see FIG. 8), and the structure of the terminal is simplified.

The boundary portion (bent portion 41) between the longer projecting portion 33 and the clamping piece portion 35 of the wire connection portion 32 of FIG. 6 can be curved into an arcuate shape. The two projecting portions 33 and 34 can have the same length, in which case the clamping piece portion 35, having the outwardly-directed projecting portion 33, is longer than the clamping piece portion 36 having the inwardly-directed projecting portion 34.

In the above embodiments, the provisional pressing operation and the complete pressing operation can be effected sequentially in the same apparatus (in which case the processes may be different from each other).

In the above embodiments, there can be used a method in which the conductor portion 9 of the wire 8 is not exposed (that is, an insulating sheath is not removed from the conductor portion), and the wire connection portion 32, disposed in contact with the insulating sheath 42, is pressed over the entire periphery thereof so as to cause the projecting extension portions 2' and 3' or the projecting extension portion 34' to bite into the conductor potion 9 through the insulating sheath 42.

In the above embodiments, the present invention is applicable to the connecting structure of connecting the terminal to the wire. However, the present invention is also effectively applicable to the terminals 1 and 31.

As described above, in the embodiments, the pair of clamping piece portions are pressed into a circular shape over the entire periphery, so that the clamping piece portions are deformed and extended in the peripheral direction, and bite, as the projecting extension portions, deep into the conductor portion. Therefore, the area of contact thereof with the conductor portion increases, and the electrical resistance is reduced, so that the electricity-conducting efficiency is enhanced. And besides, simultaneously when the projecting extension portion bite into the conductor portion, the outer periphery of the conductor portion are pressed inwardly by the clamping piece portions, and therefore the intimate contact between the wire elements of the conductor portion is enhanced, and also the intimate contact between the outer peripheral surface of the conductor portion and the inner peripheral surface of the clamping piece portions is enhanced, so that the electrical connecting ability is enhanced. When the terminal of the open barrel-type is used, the increase of the cost is prevented, and even the open barrel-type terminal achieves the wide contact area as in a closed barrel-type terminal, and the electrical connection can be positively achieved. Furthermore, the projecting extension portions bite deep into the conductor portion, and therefore the strength of fixing of the conductor portion to the wire connection portion of the terminal increases, and even when a large pulling force acts on the terminal or the wire, the withdrawal of the conductor portion is prevented, and sheath-clamping piece portions as provided at the press-clamping terminal (see FIG. 8) are not needed, so that the terminal structure is simplified. Furthermore, the pair of clamping piece portions are pressed not into a generally spectacles-shape (as in the press-clamping terminal shown in FIG. 8) but into a round shape, and therefore the wire connection portion has the narrow width and the uniform outer diameter, and in the case where a plurality of such terminals are arranged in a juxtaposed manner, the pitch of the terminals is reduced, and the connecting structure is made compact.

In the embodiments, when the clamping piece portions are compressed hard in the radial direction by the rotating dies, the clamping piece portions are smoothly extended in the peripheral direction, and the projecting extension portions are positively formed, and are caused to bite into the conductor portion, thereby enhancing the effects of the present invention.

In the embodiments, at the time of the pressing operation, the pair of projecting portions are joined together (butted together), and therefore the projecting portions are prevented from escaping (since the outer surfaces thereof are closed by the pressing jig), and therefore positively bite, as the projecting extension portions, into the conductor portion. Thus, the biting operation of the projecting extension portions is effected smoothly and positively.

In the embodiments, the pair of projecting extension portions of the same length, including the respective projecting portions, bite hard into the conductor portion in joined relation to each other, and therefore the reliability of the electrical connection is enhanced.

In the embodiments, by the provisional pressing operation, the conductor portion is fixed to the terminal against withdrawal, and the efficiency of the pressing operation is enhanced. And besides, the pair of projecting portions are initially caused to bite into the conductor portion, and by doing so, the direction of biting of each projecting portion in the pressing operation is accurately determined, so that the smooth biting operation can be effected.

In the embodiments, when the pressing operation is effected, the shorter projecting portion is disposed at the inner side while the longer projecting portion is disposed at the outer side, and the shorter projecting portion bites, as the projecting extension portion, deep into the conductor portion, thereby increasing the area of contact with the conductor portion and the fixing strength. As a result, the reliability of the electrical connection is enhanced. Particularly when only one projecting extension portion bites into the conductor portion, the degree of the angle of bending of the one projecting extension portion is enhanced as compared with the case where the two projecting extension portions bite into the conductor portion in joined relation to each other, and therefore the bent proximal end is not subjected to an excessive stress concentration, thereby eliminating the possibility of cracks and so on.

In the embodiments, at the time of the pressing operation, the distal end of the other projecting extension portion is joined to the bent proximal end of the one projecting extension portion, thereby determining the direction of biting of the one projecting extension portion, and therefore the one projecting extension portion bites accurately into the conductor portion. As a result, the reliability of the electrical connection is enhanced.

In the embodiments, the direction of biting of the one projecting extension portion is deviated outwardly from the axis of the conductor portion, and therefore the bending angle of the one projecting extension portion is made gentle, and the concentration of stresses on the bent proximal end is alleviated, thereby enhancing the effects of the present invention.

In the embodiments, when the provisional pressing operation is effected, the one projecting portion bites slightly into the conductor portion, thereby fixing the conductor portion to the terminal, so that the pressing operation can be effected easily. And besides, the other projecting portion is superposed on the outer side of the bent proximal end of the one projecting portion, and therefore the direction of biting of the one projecting portion in the pressing operation is determined, and it can accurately bite into the conductor portion.

It is contemplated that numerous modifications may be made to the method of connecting a terminal to a wire, of the present invention without departing from the spirit and scope of the invention as defined in the following claims.

What is claimed is:

1. A method of connecting a terminal to a wire, comprising the steps of:

forming straight inwardly-directed projecting portions respectively at first ends of a pair of clamping piece portions which are continuous with each other at a base at second ends located away from the first ends and form a wire connection portion of a terminal;

locating a conductor portion of a wire on inner sides having first and second proximal portions located between the first and second ends of the pair of clamping piece portions so that the conductor portion contacts the inner sides; and pressing the pair of clamping piece portions over an entire periphery thereof into a circular shape so as to extend in a peripheral direction, wherein said steps are performed in the stated order;

wherein said forming step includes the steps of:

forming a first one of the projecting portions of the pair of clamping piece portion to be shorter than a second one of the projecting portion;

bending the first one of the projecting portion inwardly at a deep angle with respect to one of the first ends of the pair of the clamping piece portions; and bending the second one of the projecting portion inwardly at a shallower angle than the deep angle with respect to another one the first ends of the clamping piece portions, wherein when the pressing step is effected, the first one of the projecting portions is caused to bite into the conductor portion of the wire while the second one of the projecting portions is held in intimate contact with an outer peripheral surface of the conductor portion.

2. The method of claim 1, wherein the pressing step is effected by a rotary swaging machine.

3. The method of claim 2, further comprising:

before the pressing step, provisionally pressing the pair of clamping piece portions to be curved; and causing a distal end of the first one of the projecting portions to bite slightly into the outer peripheral surface of the conductor portion.

4. The method of claim 2, further comprising:

before the pressing step, provisionally pressing the pair of clamping piece portions to be bent;

causing a distal end of the first one of the projecting portions to bite slightly into the outer peripheral surface of the conductor portion; and superposing the second one of the projecting portions on an outer side of a bent proximal end of the first one of the projecting portions.

5. The method of claim 1, further comprising:

before the pressing step, provisionally pressing the pair of clamping piece portions to be curved; and causing a distal ends of the first one of the projecting portions to bite slightly into the outer peripheral surface of the conductor portion.

6. The method of claim 1, further comprising:

before the pressing step, provisionally pressing the pair of clamping piece portions to be bent;

causing a distal end of the first one of the projecting portions to bite slightly into the outer peripheral surface of the conductor portion; and superposing the second one of the projecting portions on an outer side of a bent proximal end of the first one of the projecting portions.

* * * * *